US009080521B2

(12) United States Patent
Amann et al.

(10) Patent No.: US 9,080,521 B2
(45) Date of Patent: Jul. 14, 2015

(54) METHOD AND RELATED SYSTEM OF USING CRANKCASE PRESSURE TO TO DETECT PRE-IGNITION IN SPARK IGNITION ENGINE

(75) Inventors: Manfred Amann, San Antonio, TX (US); Terrence F. Alger, II, San Antonio, TX (US)

(73) Assignee: SOUTHWEST RESEARCH INSTITUTE, San Antonio, TX (US)

( * ) Notice: Subject to any disclaimer, the term of this patent is extended or adjusted under 35 U.S.C. 154(b) by 1359 days.

(21) Appl. No.: 12/660,532

(22) Filed: Mar. 1, 2010

(65) Prior Publication Data

US 2011/0213538 A1 Sep. 1, 2011

(51) Int. Cl.

| | |
|---|---|
| ***F02D 43/00*** | (2006.01) |
| ***F02D 37/02*** | (2006.01) |
| ***F02D 41/02*** | (2006.01) |
| *F02D 41/14* | (2006.01) |

(52) U.S. Cl.

CPC ..... *F02D 37/02* (2013.01); *F02D 41/021* (2013.01); *F02D 41/1498* (2013.01); *F02D 2250/11* (2013.01)

(58) Field of Classification Search

CPC ... F02D 2250/11; F02D 35/027; F02D 43/00; F02B 2075/022; F02B 2075/027

USPC ..... 701/102, 104, 105, 111, 114, 115; 123/155, 73 R, 73 AF, 196 CP, 196 S, 123/406.11, 406.12, 406.16, 406.29, 123/406.37, 406.4, 406.47, 435, 472; 73/35.07, 35.12, 114.26, 114.57, 73/114.77, 114.78

See application file for complete search history.

(56) References Cited

U.S. PATENT DOCUMENTS

| | | | | |
|---|---|---|---|---|
| 4,424,709 | A * | 1/1984 | Meier et al. | 73/114.25 |
| 4,522,170 | A * | 6/1985 | Lenk et al. | 123/198 DC |
| 5,408,872 | A * | 4/1995 | Nonaka | 73/114.33 |
| 5,603,290 | A * | 2/1997 | Swain et al. | 123/41.86 |
| 5,778,857 | A * | 7/1998 | Nakamura et al. | 123/406.37 |
| 5,978,727 | A * | 11/1999 | Jones et al. | 701/101 |
| 6,067,956 | A * | 5/2000 | Motose et al. | 123/305 |
| 6,131,503 | A * | 10/2000 | Takashima | 92/172 |
| 6,411,886 | B1 * | 6/2002 | Morra et al. | 701/111 |
| 6,994,057 | B2 * | 2/2006 | Loth et al. | 123/27 R |
| 7,536,983 | B2 * | 5/2009 | Layher et al. | 123/73 B |
| 2006/0021591 | A1 * | 2/2006 | Knaus | 123/155 |
| 2006/0037577 | A1 * | 2/2006 | Procknow | 123/193.5 |
| 2007/0204833 | A1 * | 9/2007 | Miyashita et al. | 123/406.53 |
| 2008/0202483 | A1 * | 8/2008 | Procknow | 123/572 |
| 2008/0264388 | A1 * | 10/2008 | Rosskamp et al. | 123/457 |
| 2009/0056687 | A1 * | 3/2009 | Pien | 123/73 R |
| 2009/0071451 | A1 * | 3/2009 | Schell et al. | 123/572 |
| 2010/0037876 | A1 * | 2/2010 | Robinson | 123/65 PE |
| 2010/0126259 | A1 * | 5/2010 | Vinci et al. | 73/114.23 |

* cited by examiner

*Primary Examiner* — John Kwon
*Assistant Examiner* — Johnny H Hoang
(74) *Attorney, Agent, or Firm* — Navarro Law Office, PC; Arthur I. Navarro, Esquire

(57) ABSTRACT

Methods and a related system of preventing a pre-ignition event in a spark ignition engine. Unusual crankcase pressure fluctuations often occur prior to a Low-Speed Pre-Ignition (LSPI) event. A high speed high resolution pressure transducer (60) attached to the crankcase (30) of an engine (10) takes a plurality of engine crankcase pressure measurements and relays these measurements to an engine control module (70). The pressure measurements are analyzed to determine if unusual pressure fluctuations within the crankcase are occurring. If so, one or more engine control parameters are adjusted in order to mitigate a LSPI event. Various engine control parameters may be adjusted including fuel injection, engine load and combustion timing.

20 Claims, 3 Drawing Sheets

METHOD AND RELATED SYSTEM OF USING CRANKCASE PRESSURE TO TO DETECT PRE-IGNITION IN SPARK IGNITION ENGINE

TECHNICAL FIELD

Embodiments are generally related to improved automotive engine performance. Embodiments also relate to the field of improved combustion cycles in a flame propagation engine, such as an internal combustion engine. In addition, embodiments relate to preventing a low speed pre-ignition event by recognizing unusual crankcase pressure fluctuations in a spark ignition engine.

BACKGROUND OF THE INVENTION

Pre-ignition in a flame propagation (or "spark-ignition" as the terms will be used interchangeably throughout) engine describes an event wherein the air/fuel mixture in the cylinder ignites before the spark plug fires. Pre-ignition is initiated by an ignition source other than the spark, such as hot spots in the combustion chamber, a spark plug that runs too hot for the application, or carbonaceous deposits in the combustion chamber heated to incandescence by previous engine combustion events. Many passenger car manufacturers have observed intermittent pre-ignition in their production turbocharged gasoline engines, particularly at low speeds and at medium-to-high loads. At these elevated loads, pre-ignition usually results in severe engine knock and loss of performance.

It is believed the auto-ignition of oil droplets and/or fuel-oil mixture droplets that accumulate in the piston top land area are one of the leading causes for this low-speed pre-ignition phenomenon. It is also believed that small amounts of oil may be transferred from below the oil control ring to the piston top land area due to unusual piston ring movement. At low speeds, in-cylinder pressure dynamics (compression and firing pressures) are somewhat different at high load conditions than they are at lower loads due to strongly retarded combustion phasing and high boost as well as peak compression pressures which can influence ring motion dynamics. Other possible sources of pre-ignition are believed to be soot deposits accumulating inside the combustion chamber and localized air/fuel mixture auto-ignition.

Pre-ignition can sharply increase combustion chamber temperatures and lead to rough engine operation or loss of performance. Traditional methods of eliminating pre-ignition are available and include proper spark plug selection, proper fuel/air mixture adjustment, and periodic cleaning of the combustion chambers. Such methods, however, do not attempt to predict the occurrence of pre-ignition. Given that most modern day automotive engines are equipped with onboard computerized engine management systems, a means of detecting the conditions leading up to a pre-ignition event would permit the management system to adjust one or more engine control parameters in order to mitigate an upcoming pre-ignition cycle.

Therefore, a way a determining when conditions are favorable for the occurrence of a pre-ignition event in a modern day spark ignition engine would be advantageous and allow the engine management system to take steps to prevent or mitigate the event before it occurs.

SUMMARY OF THE INVENTION

The present invention provides methods and a related system of using engine crankcase pressure measurements to detect conditions favorable to a pre-ignition event in order to mitigate pre-ignition in a modern day spark ignition engine.

According to one embodiment, disclosed is a method of preventing a pre-ignition event in a spark ignition engine comprising the steps of taking a plurality of engine crankcase pressure measurements, utilizing the pressure measurements to determine if unusual pressure fluctuations within the crankcase exist and, if so, adjusting one or more engine control parameters in order to prevent a pre-ignition event.

According to another embodiment, disclosed is a method of mitigating the occurrence of a low-speed pre-ignition event in a spark ignition engine, the engine having a computerized engine management control system and a high speed high resolution pressure transducer coupled to the engine crankcase. The method comprises the steps of the pressure transducer providing a plurality of crankcase pressure measurements to the engine management system. Next, the engine management system analyzes the crankcase pressure measurements to determine if pressure fluctuations within the engine crankcase exist and, if pressure fluctuations within the crankcase exist, the engine management control system adjusts one or more engine control parameters in order to mitigate a low-speed pre-ignition event.

Also disclosed is a system for mitigating a low-speed pre-ignition event in a spark ignition engine. The system comprises a high speed high resolution pressure transducer coupled to the crankcase of the spark ignition engine. An engine management control module includes hardware and software for adjusting various control parameters that affect the performance of the spark ignition engine and a signal pathway is provided coupling the pressure transducer to the control module. A first set of software coded instructions for analyzing pressure measurements received from the pressure transducer via the signal pathway and for analyzing the pressure measurements to determine if pressure fluctuations within the engine crankcase exist is provided. If pressure fluctuations within the crankcase exist, the software coded instructions can cause the control module to adjust one or more engine control parameters in order to mitigate a low-speed pre-ignition event.

BRIEF DESCRIPTION OF THE DRAWINGS

The accompanying figures, in which like reference numerals refer to identical or functionally-similar elements throughout the separate views and which are incorporated in and form a part of the specification, further illustrate the present invention and, together with the detailed description of the invention, serve to explain the principles of the present invention.

DETAILED DESCRIPTION

The particular values and configurations discussed in these non-limiting examples can be varied and are cited merely to illustrate at least one embodiment and are not intended to limit the scope thereof.

Figure 1:
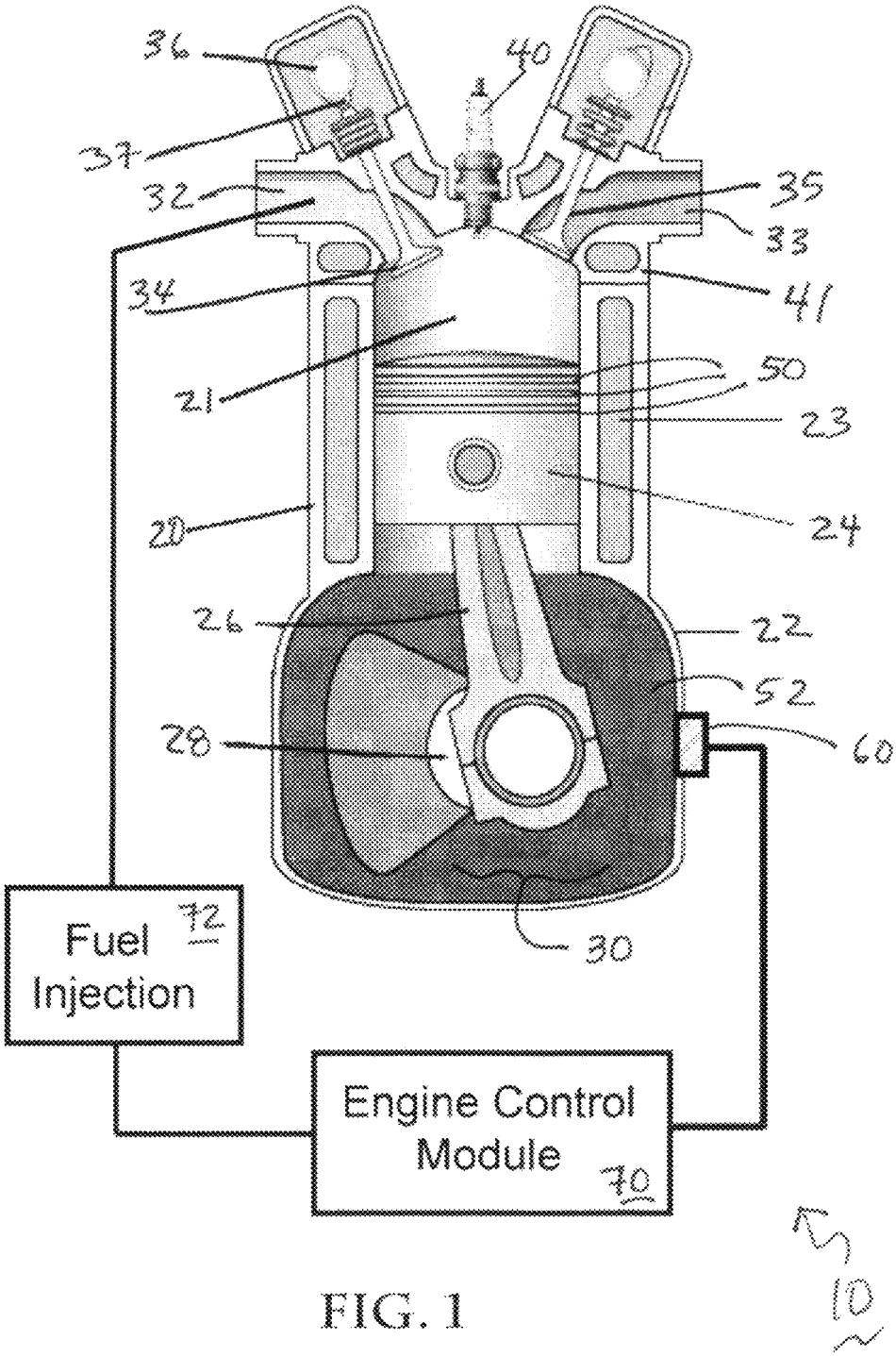
FIG. 1 illustrates an example spark ignition engine coupled to an engine control module according to one embodiment of the invention.

With reference to FIG. 1 a spark ignition engine according to a first embodiment of the invention is shown and denoted generally as 10. Engine 10 includes a cylinder 20 coupled to crankcase 22. A piston 24 travels within up and down within the combustion chamber 21 of cylinder 20 and is connected to a crankshaft 28 via a piston rod 26. The cylinder 20 is attached to the crankcase 22 which houses the crankshaft 28. The underside of the piston 24 and the crankcase 22 forms a crankcase volume 30 that will vary as the piston 24 moves up and down within the combustion chamber 21.

Engine 10 is supplied an air/fuel mixture through intake passageway 32. The air/fuel mixture is supplied to the combustion chamber 21 by the operation of intake valve 34 which, in turn, is opened and closed by the rotation of camshaft 36 and cam 37. A spark plug 40 provides the energy necessary to ignite the air/fuel mixture which combusts inside the combustion chamber 21 causing piston 24 to move downward in the direction of crankcase 22 resulting in the rotation of crankshaft 28. The resulting exhaust vapors exit through exhaust valve 35 of engine 10 via exhaust passageway 33. Valves 34 and 35, passageways 32 and 33, and spark plug 40 are typically part of the upper portion of a 4 cycle internal combustion engine, such as engine 10, commonly referred to as the head 41.

Engine lubricant 52 is maintained in a portion of the volume defined by crankcase 22. A set of piston rings 60 are used to seal the combustion chamber 21 from the crankcase 22, to support heat transfer from the piston 24 to the walls of the cylinder 20, and to regulate the consumption of engine lubricant 52. Passage 23 provides a path for coolant to travel for the extraction of engine heat.

It has been observed by the inventors of the present invention that unusual movements of the piston rings 60 often lead to increased in-cylinder pressure blow-by as well as increased transfer of engine lubricant 52 to the combustion chamber 21. These are undesirable conditions which negatively impact engine performance and efficiency. Because of the higher blow-by flow rates, pressures in the crankcase 22 can fluctuate more intensely.

The present invention provides a means for measuring these increased fluctuations by attaching a pressure transducer 60 to crankcase 22. Furthermore, the inventors of the present invention have discovered that unusual crankcase pressure fluctuations often occur prior to a Low-Speed Pre-Ignition (LSPI) event. These pressure fluctuations are attributed to unusual piston ring dynamics (piston ring fluttering) promoting the transfer of engine lubricant 52 to the combustion chamber 21 which, in turn, is believed to increase the likelihood of LSPI.

Thus, in one embodiment, a high speed high resolution pressure transducer 60 is utilized to make pressure measurements at the crankcase 22. By utilizing high-speed crankcase pressure measurements, unusual crankcase pressure fluctuations can be detected prior to a LSPI event. It has been found that unusual pressure fluctuations in the crankcase 22 are an indication that the next combustion event will likely result in a pre-ignition event. Thus, if unusual crankcase pressure is detected, the engine control system 70 can adjust one or more engine control parameters to prevent the LSPI event from occurring. Furthermore, the amplitude of such pressure fluctuations may be analyzed in order to determine if they are the result of a LSPI event or an indication that conditions are conducive to an upcoming LSPI event.

As would be understood by those of ordinary skill in the art, the engine control system 70 can implement various engine performance control strategies to mitigate an LSPI event. Such strategies could include, but are not limited to, modifying (increasing or decreasing) the amount of fuel injected into the combustion chamber 21 via, for example, fuel injection system 72. Alternatively, engine control system 70 can temporarily reduce engine load by closing the throttle, reducing boost pressures, or altering combustion timing. Other methods of countering an LSPI event may be employed as will become apparent to those of ordinary skill in the art.

Figure 2:
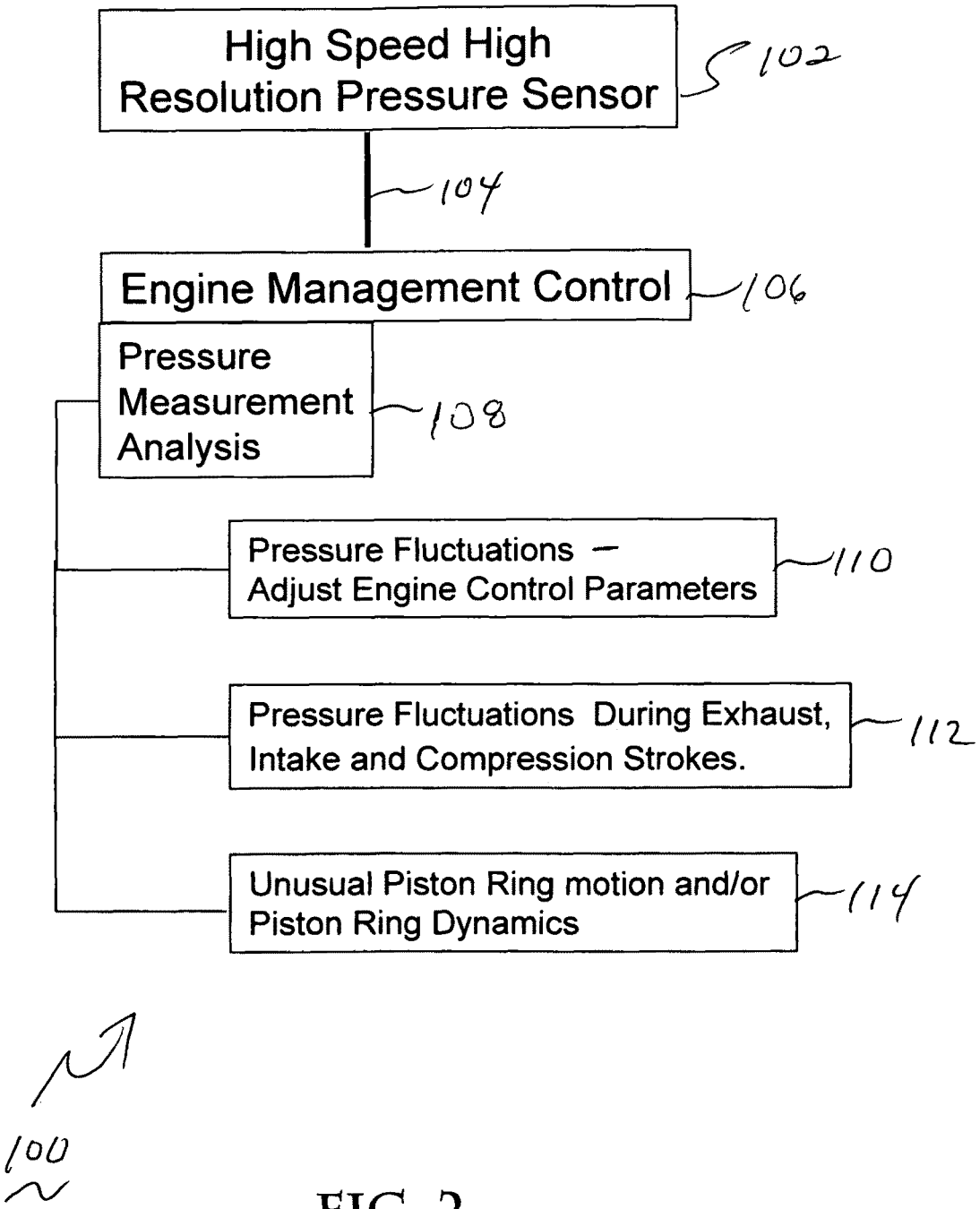
FIG. 2 is a block diagram of a system for mitigating a low-speed pre-ignition event according to one embodiment.

Referring to FIG. 2, a block diagram of a system 100 for mitigating a low-speed pre-ignition event in a spark ignition engine according to one embodiment of the invention is shown. System 100 is shown to include a high speed high resolution pressure transducer 102. Such pressure sensors are readily available and, as such, a wide variety of low-pressure, high resolution sensors could be considered. For example, for high accuracy, a piezoresistive pressure sensor, such as the Kistler 4043A2 transducer or the 4053A1 transducer could be used. For a lower cost solution, an automotive style manifold pressure sensor (i.e. Delco MAP sensor GR.2.682) could be considered. In general, when selecting a suitable transducer it is important to look for a sensor with a response time faster than the frequency of the pressure wave caused by the motion of piston rings 60. Since this frequency varies from engine to engine based on engine size and design, the sensor selection and calibration would ideally be matched to the particular engine.

As shown, pressure transducer 102 is coupled to engine management control module 106 via signal pathway 104. Preferably, control module 106 comprises the hardware and software required to diagnose and adjust various engine conditions such as, for example, the fluctuations in pressure measurements received from the pressure transducer 102. Control module 106 could be readily implemented as part of a vehicle's onboard computer which is commonly employed in modern day automobiles. Thus, the implementation of the control module 106 according to the invention can be easily incorporated into modern automotive designs.

In one embodiment, control module 106 includes a set of software coded instructions 108 in which the functions of a system for mitigating a low-speed pre-ignition event are supported. For example, software coded instructions 108 could be written and stored in the module 106 in order to analyze pressure measurements received from the pressure transducer 102 allowing the module 106 to determine if unusual fluctuations in crankcase pressure are occurring. If so, control module 106 can adjust various engine control parameters via software coded instructions 110. As discussed above, various engine control parameters may be adjusted in order to prevent a LSPI event.

Of course, once pressure measurements are made available to the engine control module 106, a set of software coded instructions 112 can be used to determine if fluctuations in pressure are occurring during the exhaust cycle, the intake cycle or during a compression stroke. Such information may be useful in diagnosing the cause of pressure fluctuations as well as the likely source. Likewise, a set of software code instructions 114 can be used to determine if there is any unusual piston ring motion or to analyze the dynamics of the piston rings 60.

Figure 3:
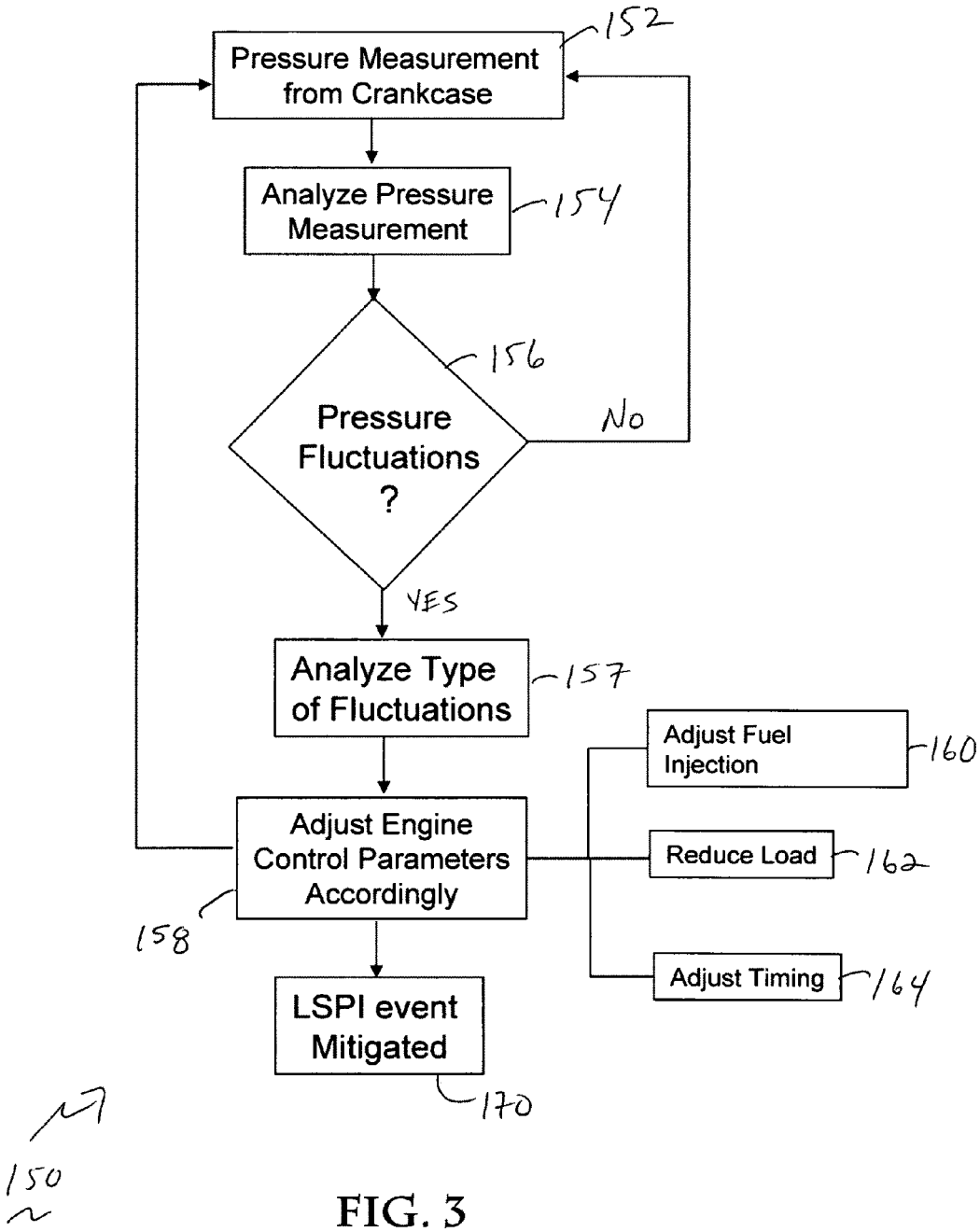
FIG. 3 is a process flow diagram illustrating a method of mitigating the occurrence of a low-speed pre-ignition event in a spark ignition engine according to one embodiment.

In FIG. 3, a process flow diagram for a method 150 of mitigating the occurrence of a low-speed pre-ignition event in a spark ignition engine is shown. Process flow begins at step 152 wherein a pressure sensor coupled to the engine crankcase provides a plurality of crankcase pressure measurements to the engine management system. Next, at step 154 the engine management system analyzes the crankcase pressure measurements to determine if pressure fluctuations within the engine crankcase exist. At step 156, it is determined if the pressure measurements indicate unusual fluctuations and, if not, process flow is redirected back to step 152.

If unusual pressure fluctuations are detected, process flow is directed to step 157 wherein the amplitude of fluctuations are analyzed to determine if they are the result of piston ring flutter or from the occurrence of a pre-ignition event within the combustion chamber 21. In general, a large amplitude change in pressure fluctuations at or near top dead center (TDC) location of the piston 24 within the combustion chamber 21 may generally be regarded as an indication that a pre-ignition even just occurred. Pressure fluctuations with lower amplitude changes tend to indicate that a pre-ignition event may occur. By analyzing the amplitude of pressure fluctuations, step 157, the engine control module can implement the correct engine management control strategy in order to mitigate potentially subsequent pre-ignition events. The distinction between those two findings come from the location of when unusual crankcase pressure fluctuations are found (at which part of the 4 stroke engine cycle). In other words, if unusual, small magnitude pressure waves are detected during the gas exchange TDC (end of exhaust stroke, beginning of intake stroke), it can be assumed that a LSPI event is going to occur during the next firing event (end of compression and beginning of expansion stroke). Engine controls strategies can be employed to prevent the LSPI event from happening. On the other hand, if unusual, large magnitude pressure fluctuations are detected at or near firing TDC, it can be concluded that a LSPI even has just occurred. Based on this information, engine control logic can be implemented such that a potential follow-on LSPI event (during the next engine cycle) is prevented.

At step 158, the engine control module can adjust various engine control parameters in order to attempt to mitigate a pre-ignition event. For example, the engine control module can adjust the amount of fuel being delivered to the combustion chamber, step 160, reduce the load on the engine by closing the throttle or reducing boost pressures, step 162, or adjust ignition timing, step 164. Other ways of mitigating a pre-ignition event may be employed as will be apparent to those of ordinary skill in the art.

It will be appreciated that variations of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A method of preventing a low-speed pre-ignition (LSPI) event in a four stroke spark ignition engine comprising the steps of:

taking a plurality of engine crankcase pressure measurements;

utilizing the engine crankcase pressure measurements to determine if pressure fluctuations within the engine crankcase exist; and if pressure fluctuations within the crankcase exist, adjusting one or more engine control parameters in order to prevent a follow-on LSPI event.

2. The method of claim 1 wherein said engine crankcase pressure measurements are taken using a high speed high resolution pressure transducer.

3. The method of claim 1 further comprising the step of analyzing the amplitude of pressure fluctuations in order to determine if the pressure fluctuations are a result of a LSPI event or from piston ring motion.

4. The method of claim 1 further comprising the step of adjusting the engine control parameters of said spark ignition engine when pressure fluctuations within the crankcase exist.

5. The method of claim 4 further comprising the step of increasing the fuel injected into the combustion chamber of said spark ignition engine.

6. The method of claim 4 further comprising the step of decreasing the fuel injected into the combustion chamber of said spark ignition engine.

7. The method of claim 1 further comprising the step of temporarily reducing the load of said spark ignition engine.

8. The method of claim 7 wherein said reducing step further comprises the step of closing the throttle of said spark ignition engine.

9. The method of claim 1 wherein said step of adjusting one or more engine control parameters in order to prevent a LSPI event comprises a step selected from the group of steps comprising:

(a) controlling the fuel injection into the combustion chamber;

(b) combustion phase control;

(c) engine load control.

10. A method of mitigating the occurrence of a low-speed pre-ignition (LSPI) event in a four stroke spark ignition engine, the engine having a computerized engine management control system and a high speed high resolution pressure transducer coupled to the engine crankcase, the method comprising the steps of:

the pressure transducer providing a plurality of crankcase pressure measurements to the engine management system;

the engine management system analyzing the crankcase pressure measurements to determine if pressure fluctuations within the engine crankcase exist; and if pressure fluctuations within the crankcase exist, the engine management control system adjusting one or more engine control parameters in order to mitigate a follow-on LSPI event.

11. The method of claim 10 further comprising the step of the engine management control system determining if pressure fluctuations within the crankcase are occurring during exhaust, intake and compression strokes.

12. The method of claim 10 further comprising the step of analyzing the amplitude of pressure fluctuations in order to determine if the pressure fluctuations are a result of a LSPI event or from piston ring motion.

13. The method of claim 10 further comprising the step of the engine management control system using the crankcase pressure measurements to detect unusual piston ring motion and/or piston ring dynamics within the combustion chamber of the spark ignition engine.

14. The method of claim 10 further comprising the step of the engine management control system using the engine crankcase pressure measurements to detect increased engine lubricant consumption within the combustion chamber of the spark ignition engine.

15. The method of claim 10 wherein said step of the engine management control system adjusting one or more engine control parameters further comprises the step of controlling the fuel injection into the combustion chamber of the spark ignition engine.

16. The method of claim 10 wherein said step of the engine management control system adjusting one or more engine control parameters further comprises the step of adjusting the spark or combustion phase control of the spark ignition engine.

17. A system for mitigating a low-speed pre-ignition LSPI event in a four stroke spark ignition engine comprising:

a high speed high resolution pressure transducer coupled to the crankcase of said spark ignition engine;

an engine management control module comprising hardware and software for adjusting various control parameters that affect the performance of the spark ignition engine;

a signal pathway coupling the pressure transducer to the control module; and a first set of software coded instructions for analyzing pressure measurements received from the pressure transducer via the signal pathway and for determining if pressure fluctuations within the engine crankcase exist and if pressure fluctuations within the crankcase exist, for adjusting one or more engine control parameters in order to mitigate a follow-on LSPI event.

18. The system of claim 17 further comprising a second set of software coded instructions for analyzing the pressure measurements received from the pressure transducer and determining if pressure fluctuations within the crankcase are occurring during exhaust, intake and compression strokes.

19. The system of claim 17 further comprising a third set of software coded instructions for analyzing the pressure measurements received from the pressure transducer and determining if unusual piston ring motion and/or piston ring dynamics are occurring within the combustion chamber of the spark ignition engine.

20. The system of claim 17 further comprising a third set of software coded instructions for analyzing the pressure measurements received from the pressure transducer and determining if increased engine lubricant consumption is occurring in the combustion chamber of the spark ignition engine.

* * * * *